US011617410B1

(12) United States Patent
Kim

(10) Patent No.: US 11,617,410 B1
(45) Date of Patent: Apr. 4, 2023

(54) PAIR OF SHOES

(71) Applicant: Jonathan Kim, Bayside, NY (US)

(72) Inventor: Jonathan Kim, Bayside, NY (US)

( * ) Notice: Subject to any disclaimer, the term of this patent is extended or adjusted under 35 U.S.C. 154(b) by 16 days.

(21) Appl. No.: 17/516,500

(22) Filed: Nov. 1, 2021

(51) Int. Cl.
*A43B 11/02* (2006.01)
*A43B 11/00* (2006.01)

(52) U.S. Cl.
CPC ..... *A43B 11/00* (2013.01); *A43B 11/02* (2013.01)

(58) Field of Classification Search
CPC ..... A43B 11/00; A43B 11/02
USPC ..... 36/138
See application file for complete search history.

(56) References Cited

U.S. PATENT DOCUMENTS 1,945,420 A * 1/1934 Charles ..... A43B 3/166 D2/915
2,024,766 A * 12/1935 Ingwer ..... A43B 3/16 36/50.1
2,178,885 A * 11/1939 Buff ..... A43C 1/006 36/99
6,295,743 B1 * 10/2001 Brooks ..... A43C 11/1493 36/105
2002/0066213 A1 * 6/2002 Wells ..... A47G 25/82 223/118
2004/0088890 A1 * 5/2004 Matis ..... A43C 11/006 36/105
2012/0180338 A1 * 7/2012 Lin ..... A43B 9/02 36/56

* cited by examiner

*Primary Examiner* — Ted Kavanaugh
(74) *Attorney, Agent, or Firm* — John K. Park; Park Law Firm

(57) ABSTRACT

At least one of the pair of shoes has a back portion of the shoe, cut from the collar of the back portion (the top of a shoe above the shoe-heel [the heel of the shoe]), and runs down the back of the shoe. The cut forms a slit running down the back portion of the shoe, forming a right-back portion and a left-back portion of the shoe. The right-side edge of the right-back portion and the left-side edge of the left-back portion are separable from the foot being inserted into the shoe. The right-side edge and the left-side edge return back to their positions when the foot is taken off or when the foot is fully inserted, not overlapping each other when the slit is not separated.

7 Claims, 3 Drawing Sheets

PAIR OF SHOES

SUMMARY

A pair of shoes is presented herein. When a person puts on a pair of shoes, the shoes are often not easily stepped into, especially for tight loafers and laced shoes. For loafers, one would repeatedly need a shoehorn, and for laced shoes, one would have to untie laces and laced them again to wear them. Unfortunately, when the person wants to put the shoes on quickly, it becomes problematic and causes much frustration. This is especially true for those who have to take off and put on their shoes constantly.

Often, in their hurry to put these shoes on, they force their feet into them and bend in and deform the back of the shoes, especially crushing the collar. After several forced wear, some shoes are permanently deformed, and the users use them as slippers, destroying the style and the intended purpose of the shoe design. Moreover, because of the now flattened rear of the shoes and the crushed collar, shoes are uncomfortable; wearing shoes as they were unintended. Furthermore, because the back-heels of the wearer constantly press down on the flattened back of the shoes and the crushed collar, the heels of the wearer may be injured and suffer from pain.

The shoes described herein avoids the need for a shoehorn and are designed to quickly wear them without destroying the shoes. At least one of the pair of shoes has a back portion of the shoe, cut from the collar of the back portion (the top of a shoe above the shoe-heel [the heel of the shoe]), and run down the back of the shoe. The cut forms a slit running down the back portion of the shoe. One side of the cut is a right-back portion, and the other side of the cut is a left-back portion of the shoe. The right-back portion has a right-side edge, and the left-back portion has a left-side edge. The right-side edge and the left-side edge are separable from the foot being inserted into the shoe. The right-side edge and the left-side edge return back to their positions when the foot is taken off or when the foot is fully inserted, not overlapping each other when the slit is not separated. Although it is preferable that the right-side edge and the left-side edge do not overlap, it is within the breadth of the claims described herein. Also, it is preferable to have each shoe of the pair be designed to have a cut at its back portion.

A variation of the shoes described herein has the right-side edge of the right-back portion and the left-side edge of the left-back portion form an opening, so the slit starts from the opening. As an alternate design, the slit may be divided into two parts: an upper part of the slit above the opening and a lower part of the slit below the opening. It is preferable to have the upper part of the slit longer in length than the lower part of the slit, so the entry of the foot can force the slit separated wide to easily accept and accommodate an entry of the foot into the shoe. The slit is designed to run up to a collar so that the right-side edge of the right-back portion is separable from the left-side edge of the left-back portion at the collar.

The stretchable material is attached to the inside of the back portion, overlapping both the right-back portion and the left-back portion inside the shoe. The stretchable material provides elasticity to separate the slit apart when the back-heel of the foot is pushed into the shoe and to pull the slit back together after the foot is inserted into the shoe. It is preferable that the stretchable material is not stitched completely on the upper part of the stretchable material so the slit may freely open up and close together due to the elasticity of the stretchable material. The stretchable material may be, including but not limited to, spandex, rubber, ribbed fabric, stretchable fabric, and the like. The stretchable material is elastic and should maintain its shape over extended use.

A variation of the shoes presented herein has the right-back portion extending upwards to form a right lip and the left-back portion extending upwards to form a left lip. The right lip and the left lip together form a elongated-collar region above and away from a shoe-heel. The elongated-collar region may be used as a handle to hold to assist the foot inserted into the shoe. In this variation and other variations, the slit does not have to reach the collar, so the elongated-collar region does not separate at the collar but is held as one piece.

One of the benefits is comfortable and quick inserting into and taking out of a foot from the shoe and cost savings from not deforming the shoe from extended use. The benefit is most noticeable when a shoehorn is not needed when the shoe is new and/or tight on foot. The user would not have to make several awkward steps gingerly when putting on the shoe without a shoehorn. Also, the user would not have to sit down or squat to use a shoehorn putting on the shoe because the back portion will open up along the slit to easily accommodate a foot into the shoe.

These and other features, aspects, and advantages of the improved shoes will become better understood with reference to the accompanying specification, writing, drawings, and submission, all of which are incorporated herein.

BRIEF DESCRIPTION OF THE DRAWINGS

These and other features, aspects, and advantages of the shoes will become better understood with reference to the accompanying drawings, wherein.

DETAILED DESCRIPTION EMBODIMENTS OF THE INVENTION

Figure 3:
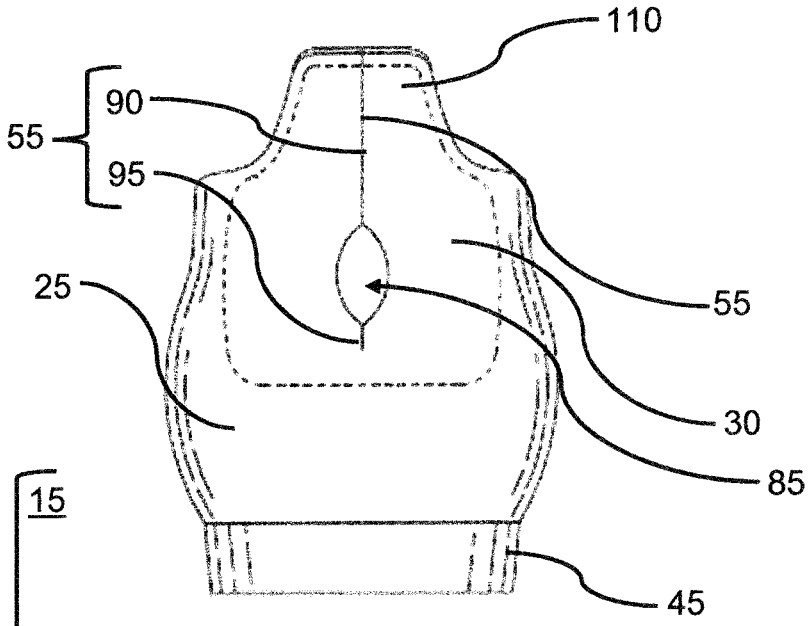
FIG. 3: the shoe showing its back portion.
Figure 4:
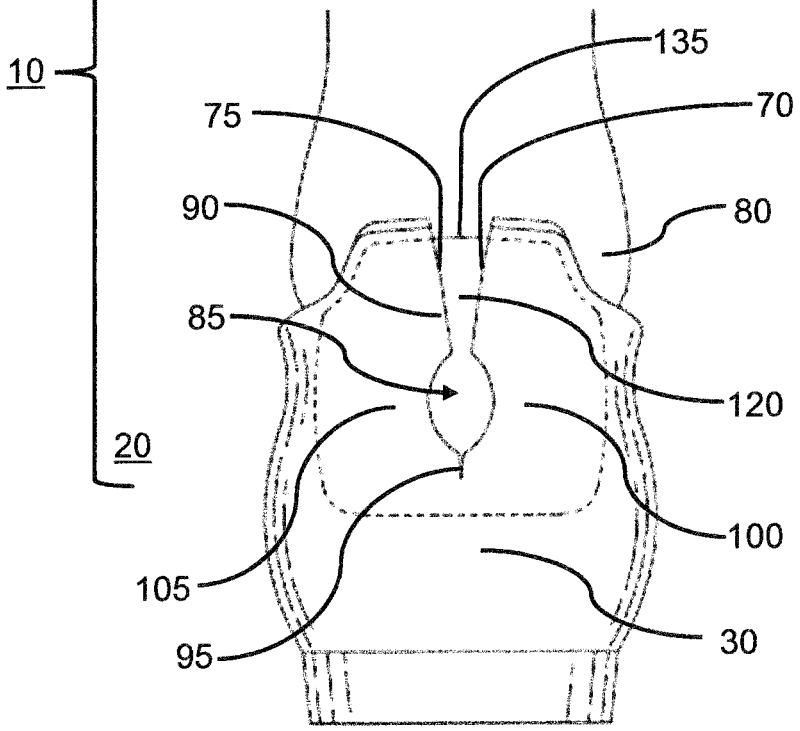
FIG. 4: the shoe with a foot being inserted into it.

A pair of shoes 10 (FIGS. 3 and 4) is described in detail as shown in Figs. FIG. 3 shows a left shoe 15, and FIG. 4 shows a right shoe 20.

Figure 1:
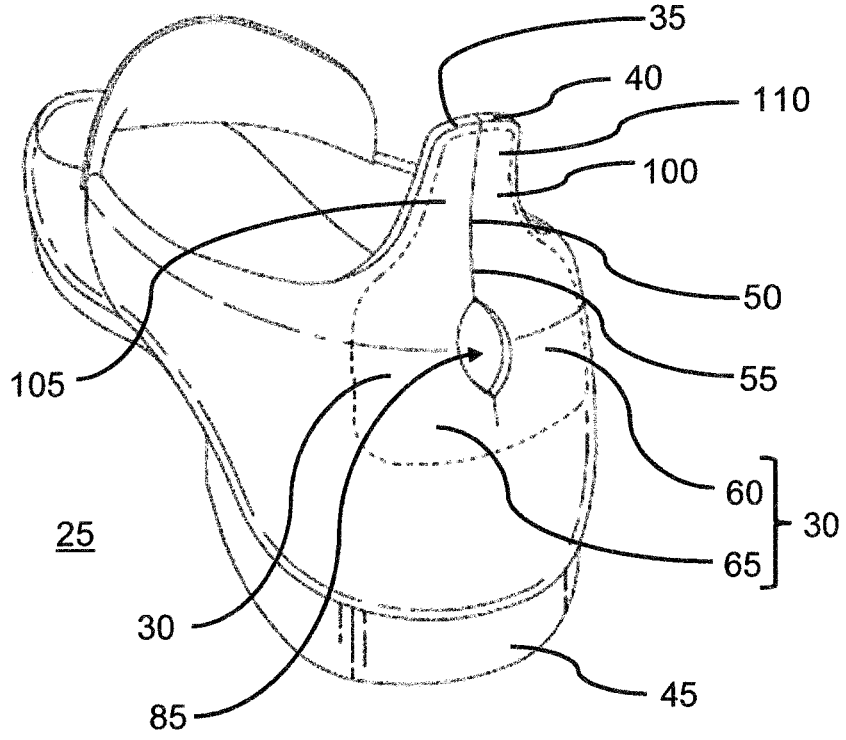
FIG. 1: a shoe showing its back portion.

FIG. 1 shows a shoe 25 (either of 15 or 20), showing a back portion 30 of the shoe 25, cut from the collar 35 of the back portion 30 (the top of the shoe 40 above the shoe-heel 45 (the heel of the shoe). A cut 50 runs down along the back portion 30 of the shoe. The cut 50 forms a slit 55 running down the back of portion 30 of the shoe 25. One side of the cut 50 is a right-back portion 60, and the other side of the cut 50 is a left-back portion 65 of the shoe 25. The right-back portion 60 has a right-side edge 70, and the left-back portion 65 has a left-side edge 75, as shown in FIG. 4.

Figure 2:
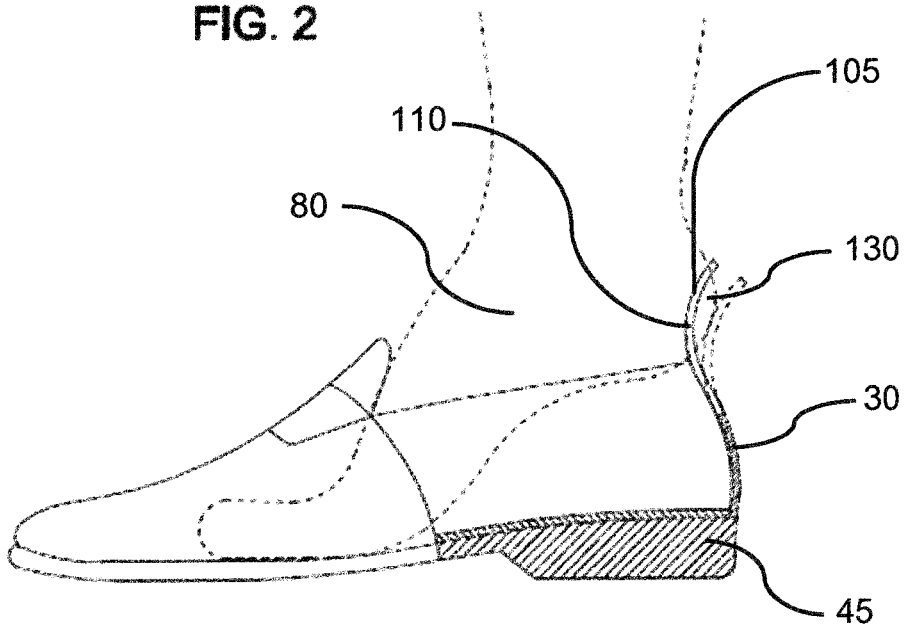
FIG. 2: the shoe with a foot being inserted into it.

As shown in FIGS. 2 and 4, the right-side edge 70 and the left-side edge 75 are separable from the foot 80 is inserted into the shoe 25, and the right-side edge 70 and the left-side edge 75 return back to their positions when foot 80 is either taken out or when the foot 80 is fully inserted into the shoe 25. As one can see from Figs., the right-side edge 70 and the left-side edge 75 are not overlapping each other when the slit 55 is not separated; the right-side edge 70 and the left-side edge 75 meet at the same thickness (not offset) to align and to form a smooth rear surface (that is, the back portion 30) of the shoe 25. Although it is preferable that the right-side edge 60 and the left-side edge 70 do not overlap, it is within the breadth of the claims described herein to have a portion of the right-side edge 60 and the left-side edge 70 overlap, or parts of the right-side edge 60 and the left-side edge 70 stitched together. Also, it is preferable to have both shoes of the pair have the same design for the back portions 30; that is, each shoe has a cut 50 on the back portion 30, but not required.

A variation of the shoes 25 described herein has the right-side edge 70 of the right-back portion 60 and the left-side edge 75 of the left-back portion 65 form an opening 85, so the slit 55 starts from the opening 85. The opening 85 allows the slit 55 on the back portion 30 of the shoe 25 to easily spread and open up to receive the foot 80. Moreover, the opening 85 prevents the slit 55 from ripping beyond the opening 85. Furthermore, the opening 85 may give loose space behind the back-heel 130 for comfort.

The slit 55 may be divided into two parts: an upper part 90 of the slit 55 above the opening 85 and a lower part 95 of the slit 55 below the opening 85. When the back portion 30 of the shoe 25 has both the upper part 90 of the slit 55 and the lower part 95 of the slit 55, it is preferable to have the upper part 90 of the slit 55 longer in length than the lower part 95 of the slit 55. The entry of the foot 80 can easily force the slit 55 to separate wide for easily accepting and accommodating the foot 80 into the shoe 25.

FIG. 3 shows the back portion 30 of the shoe 25. As shown, the slit 55 is designed to run up to a collar 35 and to the very top 40 of the shoe 25 so that the right-side edge 70 of the right-back portion 60 is separable from the left-side edge 75 of the left-back portion 65 at the collar 35, separating the top 40 of the shoe 25 and the collar 35 of the shoe 25.

Another variation of the pair of shoes 10 presented herein has the right-back portion 60 extending upwards to form a right lip 100 and the left-back portion 65 extending upwards to form a left lip 105. The right lip 100 and the left lip 105 form an elongated-collar region 110 above and away from a shoe-heel 45. The elongated-collar region 110 may be used as a handle to hold to assist the foot 80 inserted into the shoe 25. Also, the lips 100, 105 allow the slit 55 to open more easily and widely for the foot 80 to easily push into the shoe 25. In this variation, as well as in other variations, the slit 55 does not have to reach or run through the collar 35 so the elongated-collar region 110 does not separate at the collar 25 at the top 40 of the shoe 25, keeping the collar 25 as one piece, not separated. FIG. 4 shows (also in FIG. 2) the foot 80 is being inserted into the shoe 25. As the foot 80 (the back-heel 130) is pushed onto the back portion 30, especially when the shoe 25 is equipped with the elongated-collar region 110, the back-heel 130 of the foot 80 pushes down on the inside 125 of the back portion 30, forcing the slit 55 to open easily along with the slit 55.

Figure 5:
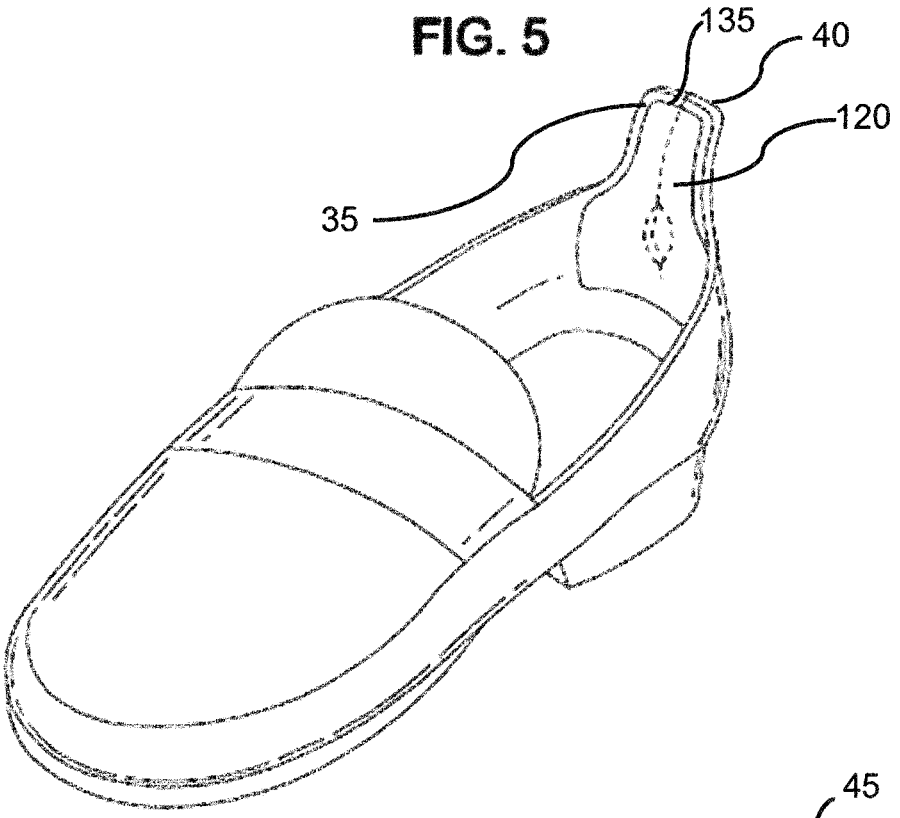
FIG. 5: the shoe showing its inside with the back portion covered with stretchable material.

The stretchable material 120 is attached to the inside 125 of the back portion 30 (shown in FIG. 5), overlapping parts of both the right-back portion 60 and the left-back portion 65 inside the shoe 25. The stretchable material 120 provides elasticity to separate the slit 55 apart when the back-heel 130 of the foot 80 is pushed into the shoe 25 and to pull the slit 55 back together after the foot 80 is inserted into the shoe 25 or when the foot 80 is removed from the shoe 25. It is preferable that the stretchable material 120 is not stitched completely (otherwise, completely affixed) on the upper part 135 of the stretchable material 120 so the slit 55 may freely open up and close together due to the elasticity of the stretchable material 120. The stretchable material 120 may be, including but not limited to, spandex, rubber, ribbed fabric, stretchable fabric, and the like. The stretchable material 120 is elastic and should maintain its shape over extended use.

Figure 6:
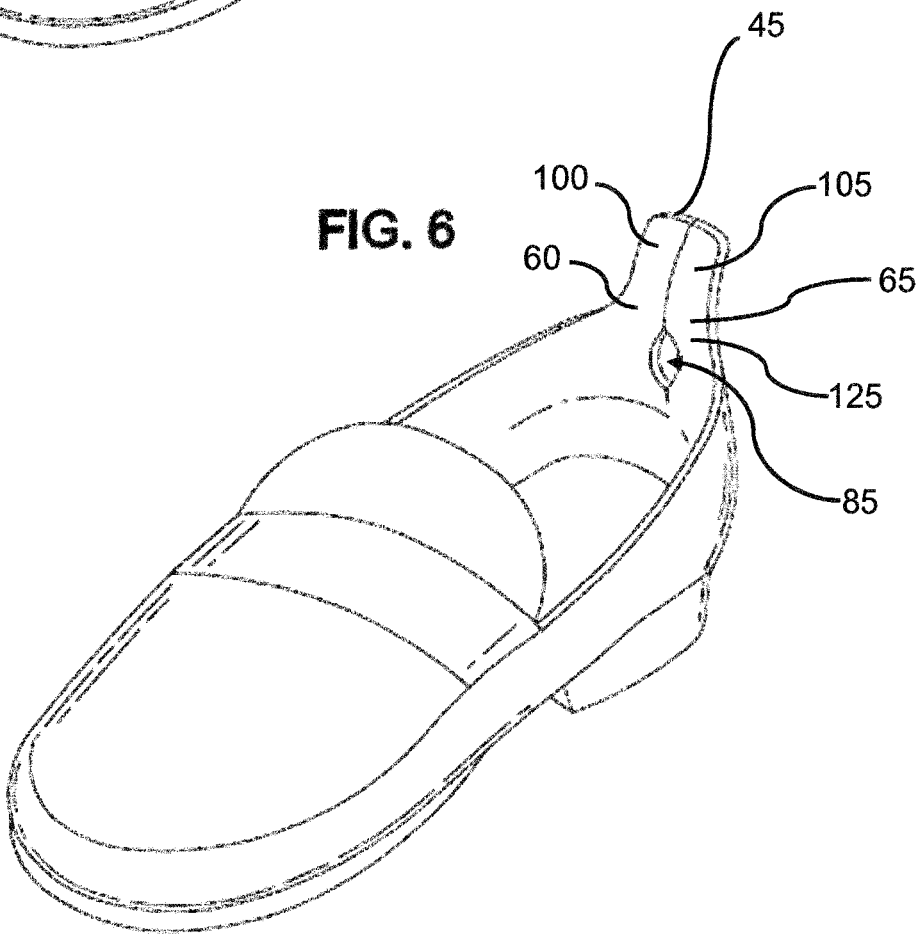
FIG. 6: the shoe showing its inside with the back portion without a stretchable material.

FIG. 6 shows a version of the shoes 10 without the stretchable material 120. The leather or the material used for the shoe 25 may have sufficient elasticity to separate and bring back the back portion 30 of the shoe 25.

While the description, drawings, and references have presented, shown, and described with reference to different embodiments thereof, it will be appreciated by those skilled in the art that variations in form, detail, compositions, and operation may be made without departing from the spirit and scope of the disclosure.

What is claimed is:

1. A pair of shoes comprising of a shoe, wherein the shoe has a back portion designed to accept a back-heel of a foot, wherein the back portion comprises of a right-back portion and a left-back portion, wherein the right-back portion and the left-back portion form a slit so that the right-back portion having a right-side edge is separable from a left-side edge of the left-back portion, wherein the slit runs up to a collar so that the right-side edge of the right-back portion is separable from the left-side edge of the left-back portion at the collar, wherein the slit forms an opening, wherein the right-side edge of the right-back portion and the left-side edge of the left-back portion form the opening, and wherein the opening is located between a lower part of the slit and a upper part of the slit.

2. The pair of shoes of claim 1, wherein the upper part of the slit is longer in length than the lower part of the slit.

3. A pair of shoes comprising of a shoe, wherein the shoe has a back portion designed to accept a back-heel of a foot, wherein the back portion comprises of a right-back portion and a left-back portion, wherein the right-back portion and the left-back portion form a slit so that the right-back portion having a right-side edge is separable from a left-side edge of the left-back portion, wherein a stretchable material is attached to a inside of the back portion, overlapping both the right-back portion and the left-back portion, wherein the stretchable material provides elasticity to separate the slit apart when the back-heel of the foot is pushed into the shoe and to pull the slit back together after the foot is inserted into the shoe, wherein the slit runs up to a collar so that the right-side edge of the right-back portion is separable from the left-side edge of the left-back portion at the collar, wherein the slit forms an opening, wherein the right-side edge of the right-back portion and the left-side edge of the left-back portion form the opening, and wherein the opening is located between a lower part of the slit and a upper part of the slit.

4. The pair of shoes of claim 3, wherein the upper part of the slit is longer in length than the lower part of the slit.

5. A pair of shoes comprising of a shoe, wherein the shoe has a back portion designed to accept a back-heel of a foot, wherein the back portion comprises of a right-back portion and a left-back portion, wherein the right-back portion and the left-back portion form a slit so that the right-back portion having a right-side edge is separable from a left-side edge of the left-back portion, wherein the right-back portion extends upward to form a right lip and the left-back portion extends upward to form a left lip, wherein the right lip and the left lip form a elongated-collar region above and away from a shoe-heel, wherein the slit runs up to a collar so that the right-side edge of the right-back portion is separable from the left-side edge of the left-back portion at the collar, wherein the slit forms an opening, wherein the right-side edge of the right-back portion and the left-side edge of the left-back portion form the opening, and wherein the opening is located between a lower part of the slit and a upper part of the slit.

6. The pair of shoes of claim 5, wherein the upper part of the slit is longer in length than the lower part of the slit.

7. A pair of shoes comprising of a shoe, wherein the shoe has a back portion designed to accept a back-heel of a foot, wherein the back portion comprises of a right-back portion and a left-back portion, wherein the right-back portion and the left-back portion form a slit, wherein the right-back portion has a right-side edge and the left-back portion has a left-side edge, wherein the right-side edge and the left-side edge are separable from the foot inserted into the shoe and wherein the right-side edge and the left-side edge do not overlap when the slit is not separated, wherein the slit runs up to a collar so that the right-side edge of the right-back portion is separable from the left-side edge of the left-back portion at the collar, wherein a stretchable material is attached to a inside of the back portion, overlapping both the right-back portion and the left-back portion, wherein the stretchable material provides elasticity to separate the slit apart when the back-heel of the foot is pushed into the shoe and to pull the slit back together after the foot is inserted into the shoe, wherein the slit forms an opening, wherein the right-side edge of the right-back portion and the left-side edge of the left-back portion form the opening, and wherein the opening is located between a lower part of the slit and a upper part of the slit and wherein the upper part of the slit is longer in length than the lower part of the slit.

* * * * *